United States Patent [19]

Moriwaki

[11] 4,447,216

[45] May 8, 1984

[54] STEM SEALING APPARATUS HAVING EXTERNAL TIPPING OFF BURNERS

[75] Inventor: Takeshi Moriwaki, Yokohama, Japan

[73] Assignee: Tokyo Shibaura Denki Kabushiki Kaisha, Kawasaki, Japan

[21] Appl. No.: 361,618

[22] Filed: Mar. 25, 1982

[30] Foreign Application Priority Data

Mar. 31, 1981 [JP] Japan ..... 56-48029

[51] Int. Cl.[3] ..... H01J 9/34; H01J 9/40

[52] U.S. Cl. ..... 445/70; 65/138; 65/270

[58] Field of Search ..... 445/66, 69, 70, 26, 445/43; 65/138, 34, 270

[56] References Cited

U.S. PATENT DOCUMENTS 3,068,909 12/1962 Wilson et al. ..... 445/70
4,184,728 1/1980 Grenfell et al. ..... 445/69
4,382,645 5/1983 Hayakawa et al. ..... 445/69

FOREIGN PATENT DOCUMENTS 54-100170 8/1979 Japan ..... 445/70
2082835 3/1982 United Kingdom ..... 445/70

*Primary Examiner*—Kenneth J. Ramsey
*Attorney, Agent, or Firm*—Cushman, Darby & Cushman

[57] ABSTRACT

An apparatus for manufacturing bulbs comprises a mount holder having a hole through which an exhaust tube is passed loosely and holding a mount, a sealing burner arranged around the holder for fusing the contact portions of a stem and the opening edge of a bulb body, a butting plate arranged around the holder so as to be able to reciprocate along the axis of the holder, and capable of pressing on the fused contact portions, and two tipping-off burners for sealing off the exhaust tube. The holder includes two flame inlet ports opening in the outer surface of the holer and communicating with the hole. The burners are located outside the holder, and can move between a position where it can inject flames into the ports and a position where it does not prevent the movement of the abutting plate.

15 Claims, 3 Drawing Figures

STEM SEALING APPARATUS HAVING EXTERNAL TIPPING OFF BURNERS

BACKGROUND OF THE INVENTION

The present invention relates to an apparatus for manufacturing bulbs capable of solely performing both sealing between the bulb body and mount and tipping-off of the exhaust tube of the mount.

In general, a method for manufacturing a bulb, e.g., a fluorescent lamp, includes a sealing process for sealing a flare portion of a mount to the opening edge of a tubular bulb body, and an exhaust process for exhausting in the bulb body through an exhaust tube extending from a mount, introducing mercury and inert gas into the bulb through the exhaust tube, and then tipping-off the exhaust tube. Recently, there has been developed a manufacturing apparatus capable of solely executing both those processes in succession. This apparatus includes a head body and a mount holder attached to the head body to hold the mount of the bulb. The mount holder is in the form of a cylinder with a hole in which the exhaust tube of the mount is to be inserted. Fitted in the hole of the mount holder, moreover, is a cylindrical tipping-off burner for tipping-off the exhaust tube. The apparatus further includes a sealing burner arranged around the mount holder for sealing the flare portion of the mount and the opening edge of the bulb body, and a butting plate so arranged around the mount holder as to be able to reciprocate along the axis of the mount holder for pressing and securely sealing the flare portion and the opening edge of the bulb body. Furthermore, the apparatus includes an exhaust head located adjacent and opposite to the mount holder for airtightly chucking the extended end portion of the exhaust tube, exhausting in the bulb through the exhaust tube and introducing inert gas and mercury into the bulb.

The manufacturing apparatus of the above-mentioned construction is used for manufacturing conventional fluorescent lamps with bulb diameters ranging about from 29 mm to 38 mm. Recently, however, there have been developed lamps with reduced bulb diameters for higher efficiency. When using the aforesaid apparatus for the manufacture of the fluorescent lamps with the reduced bulb diameters, the inside diameter of the butting plate, which is functionally expected to be a little smaller than the outside diameter of the bulb, must be reduced in proportion to the reduction of the bulb diameter. Also, the outside diameter of the mount holder need be reduced correspondingly to the inside diameter of the butting plate. Since the tipping-off burner is fitted in the mount holder and the size of the tipping-off burner is defined, the inside diameter of the mount holder may not be reduced. Accordingly, if the outside diameter of the mount holder is reduced as aforesaid, the wall of the mount holder will extremely be thinned, possibly leading to deterioration of the mount holder in mechanical strength.

The above-mentioned apparatus having the tipping-off burner built in the mount holder, moreover, is complicated in construction to require much labor for assembly and disassembly for maintenance and inspection, for example. Furthermore, in such apparatus, it is hard to observe the operating state of the tipping-off burner from the outside.

SUMMARY OF THE INVENTION

Accordingly it is an object of the present invention to provide an apparatus for manufacturing bulbs, and more particularly to an apparatus which can manufacture bulbs having a small diameter, can yet keep the wall thickness of a mount holder and hence satisfactory mechanical strength thereof, has a simple structure and it allows an apparatus easily to observe how a tipping-off burner operates.

According to one aspect of the present invention, an apparatus for manufacturing bulbs comprises a mount holder having an exhaust tube insertion hole through which an exhaust tube of the bulb is passed loosely and holding a mount of the bulb, a sealing burner arranged around the mount holder for sealing the portions of the periphery of a stem and the opening edge of a bulb body, a butting plate arranged around the mount holder so as to be able to reciprocate along the axis of the mount holder, and capable of pressing on the after sealing between the stem and the bulb body, and at least one tipping-off burner for tipping-off the exhaust tube. The mount holder includes at least one flame inlet port opening in the outer surface of the mount holder and communicating with the exhaust tube insertion hole. The tipping-off burner is located outside of the mount holder, and can move between a position where it can inject flames into the flame inlet port and a position where it does not prevent the movement of the butting plate.

According to the manufacturing apparatus thus constructed, the tipping-off burner is located outside of the mount holder, so that it never puts restrictions on the inside diameter of the mount holer. Thus, the wall thickness of the mount holder, and hence satisfactory mechanical strength thereof, may be maintained. Since the tipping-off burner is not inside of the mount holder, moreover, the mount holder may be simplified in construction, and the operating state of the tipping-off burner can easily be observed from the outside.

BRIEF DESCRIPTION OF THE DRAWINGS

FIGS. 1 to 3 show an apparatus for manufacturing bulbs according to an embodiment of the present invention, in which:

FIG. 1 is a longitudinal sectional view of the apparatus;

FIG. 2 is a partially broken plan view schematically showing the positional relationships between a mount holder and tipping-off burners; and FIG. 3 is a cross-sectional view taken along line III—III of FIG. 1.

DETAILED DESCRIPTION OF THE PREFERRED EMBODIMENT

There will now be described in detail an embodiment of the present invention with reference to the accompanying drawings.

Figure 1:
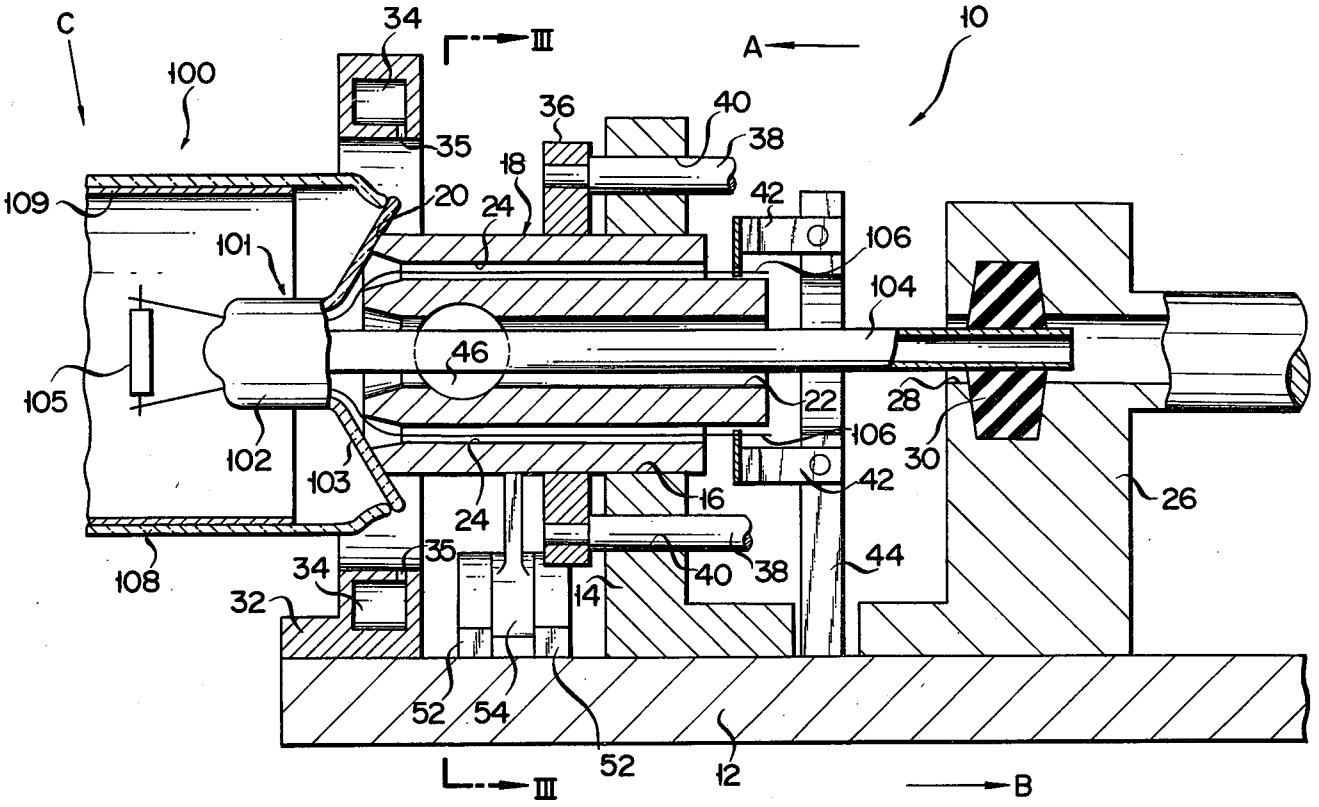

As shown in FIG. 1, an apparatus 10 for manufacturing bulbs includes a movable base 12 and a sealing head 14 fixed on the base 12. The sealing head 14 has a through-hole 16 in which a cylindrical mount holder 18 is inserted and fixed. The mount holder 18 holds a mount 101 of a fluorescent lamp 100. The mount 101 is provided with a stem 102 having a flare portion 103, an exhaust tube 104 extending from the stem 102, and two lead wires 106 the forward ends of which are connected with a filament coil 105. The mount holder 18 has a tapered supporting surface 20 on the outer periphery of its forward end, which is to abut on and fit in with the inner surface of the flare portion 103 to locate the mount 101. Further, the mount holder 18 is provided with an exhaust tube insertion hole 22 coaxial therewith, and a pair of lead wire insertion holes 24 parallel to the exhaust tube insertion hole 22 and opposed to each other at an angular distance of 180° along the circumferential direction of the mount holder 18. The exhaust tube 104 is passed loosely in the exhaust tube insertion hole 22, and the lead wires 106 are passed through their corresponding lead wire insertion holes 24. The outside diameter of the mount holder 18 is smaller than that of the flare portion 103.

The apparatus 10 further includes an exhaust head 26 which is disposed on the base 12 so as to be able to move along the axis of the mount holder 18. The exhaust head 26 has a leading-in hole 28 coaxial with the exhaust tube insertion hole 22 of the mount holer 18, and a ring-shaped rubber clamp 30 is fitted in the leading-in hole 28. The extended end portion of the exhaust tube 104 is inserted in the leading-in hole 28, and airtightly chucked by the rubber clamp 30. The leading-in hole 28 communicates with a gas replacing apparatus (not shown).

Moreover, the apparatus 10 includes an annular-shaped sealing burner 32 fixed on the base 12, coaxial with the mount holder 18 and surrounding the periphery of the flare portion 103 held by the mount holder 18. The sealing burner 32 is provided with a continuous circumferential gas passage 34, and a number of flame nozzles 35 facing the periphery of the flare portion 103 open in the inner peripheral surface of the gas passage 34 at regular intervals along the circumferential direction thereof. The gas passage 34 communicates with a gas supply pipe (not shown).

The apparatus 10 further includes an annular-shaped butting plate 36 arranged coaxialy with the mount holder 18 and slidable along the outer peripheral surface of the mount holder 18. The inside diameter of the butting plate 36 is a little greater than the outside diameter of the mount holder 18, and is smaller than the outside diameter of the flare portion 103. As for the outside diameter of the butting plate 36, it is smaller than the inside diameter of the sealing burner 32. The butting plate 36 is coupled with a pair of guide bars 38, which are passed through their corresponding guide holes 40 bored through the sealing head 14. The other ends of the guide bars 38 are coupled with driving means (not shown). The driving means forces out the guide bars 38 in the direction of an arrow A of FIG. 1 to cause the butting plate 36 to slide along the outer peripheral surface of the mount holder 18 toward the flare portion 103.

In FIG. 1, numeral 108 designates a straight-tube-type bulb body with a diameter of approximately 25 mm supported by a bulb holder (not shown), and numeral 109 designates a phosphor film coated on the inner surface of the bulb 108. There are also shown conductive terminals 42 for energizing the lead wires 106, and a support plate 44 fixed on the base 12 to support the terminals.

Figure 2:
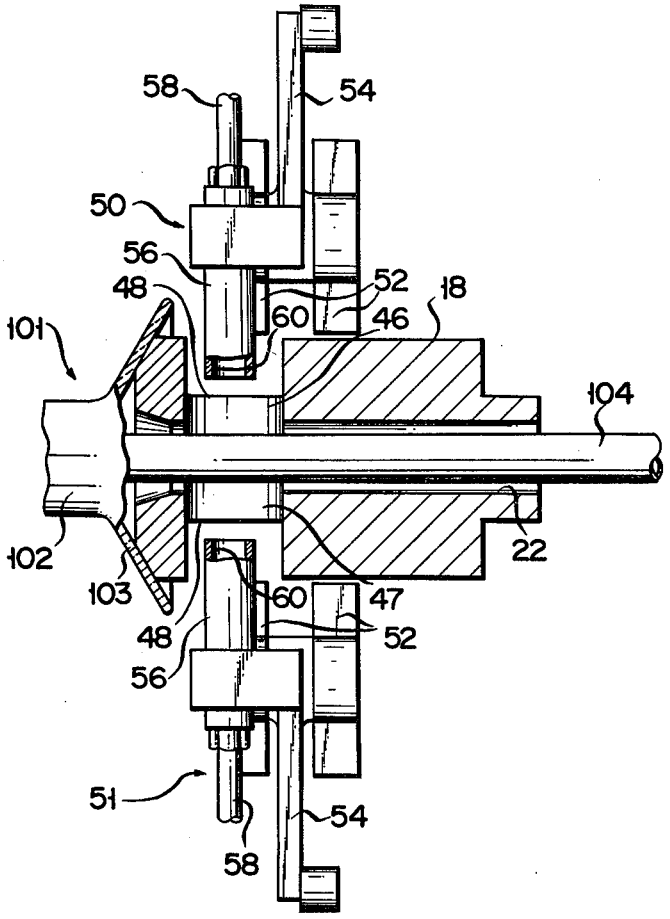
Figure 3:
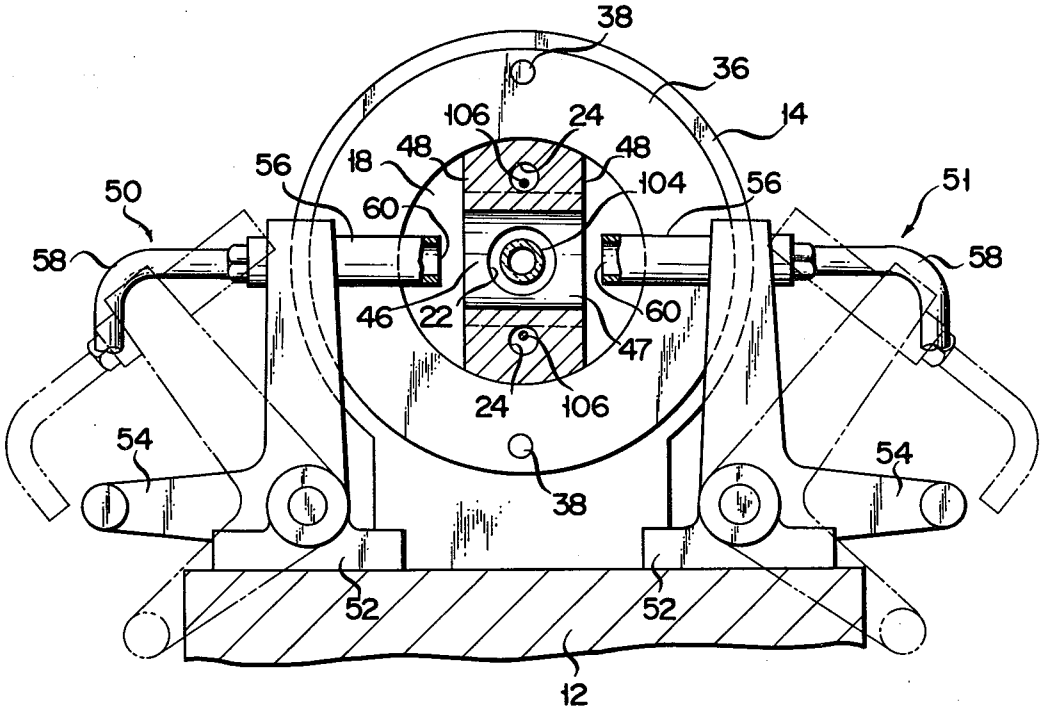

As shown in FIGS. 1 to 3, the mount holder 18 has a through hole which communicates with the exhaust tube insertion hole 22. One end 46 of the hole, or a flame inlet port 46, opens to the outer surface of the mount holder 18. So does the other end 47 of the hole, or a flame inlet port 47. The hole extends perpendicular to the exhaust tube insertion hole 22. The flame inlet ports 46 and 47 are positioned at an angular distance of 180° from each other and at an angular distance of 90° from the lead wire insertion holes 24 along the circumferential direction of the mount holder 18. Thus, the hole communicates neither one of the lead wire insertion hole 24 nor the other hole 24. The ports 46 and 47 are coaxial, of course, and have the same diameter which is greater than that of the hole 22. Those portions of the mount holder 18 in which the hole is made are cut away, thus forming two parallel, rectangular surfaces 48 having a width substantially equal to the diameter of the flame inlet ports 46 and 47.

Furthermore, the apparatus 10 includes two tipping-off burners 50 and 51 mounted on the base 12 outside of the mount holder 18. The tipping-off burners 50 and 51 are each composed of a pair of brackets 52 fixed on the base 12, an L-shaped rocking link 54 rockably supported by the brackets 52, and a burner body 56 fixed to the top end portion of the rocking link 54. The burner body 56 is connected with a gas source (not shown) by means of a gas supply pipe 58. The tipping-off burners 50 and 51 are so arranged as to rock along a plane at right angles to the central axis of the mount holder 18. As shown in FIG. 3, moreover, the tipping-off burners 50 and 51 each rock between an operating position represented by full line, in which the burners 50 and 51 can inject flames into the flame inlet ports 46 and 47, and a non-operating position represented by two-dot chain line, in which the burners 50 and 51 do not prevent the movement of the butting plate 36. In the operating position, a flame nozzle 60 of each burner body 56 is located adjacent and opposite to the opening of its corresponding flame inlet ports 46 or 47. In the nonoperating position, on the other hand, the burner body 56 and the rocking link 54 are withdrawn to the outside of the outer periphery of the butting plate 36.

There will now be described in detail the operation of the bulb manufacturing apparatus of the above-mentioned construction.

Referring to FIG. 1, the sealing head 14 and the exhaust head 26, moved together with the base 12 in the direction of an arrow B, receives the mount 101. At this time, the exhaust tube 104 of the mount 101 is passed from the side of the supporting surface 20 of the mount holder 18 through the exhaust tube insertion hole 22, and the extended end portion of the exhaust tube 104 is inserted into the leading-in hole 28 of the exhaust head 26. At the same time, the lead wires 106 are passed through their corresponding lead wire insertion holes 24 to have their led-out ends in contact with their corresponding conductive terminals 42. After the inside of the flare portion 103 of the mount 101 is then caused to abut on the supporting surface 20 of the mount holder 18 to locate the mount 101, the rubber clamp 30 is constricted to clamp the extended end portion of the exhaust tube 104. In the aforesaid process of operation, the straight-tube-type bulb body 108, supported by the bulb holder (not shown), is carried in the direction of an arrow C to the position of FIG. 1 to be held therein.

Subsequently, the base 12 is moved in the direction to the arrow A to move together the sealing head 14 and the exhaust head 26 holding the mount 101, thereby bringing the peripheral portion of the flare portion 103 to contact with the opening edge portion of the bulb body 108. Then, the sealing burner 32 is ignited, gas flames injected from the flame ports 35 are thrown on the contact portions of the bulb body 108 and the flare portion 103 to fuse each other. The bulb body 108 and the flare portion 103 are sealed by such heat fusion. In this sealing process, the guide bars 38 are pushed in the direction of the arrow A to move the butting plate 36 toward the flare portion 103. Then, the butting plate 36 presses softly on the fused contact portions of the bulb body 108 and the flare portion 103, thereby promoting the union of glass as the material of these portions. Thereafter, the butting plate 36 is restored to its original position. In the processes of operation so far, the tipping-off burners 50 and 51 are each located in the non-operating position represented by two-dot chain line in FIG. 3, in which the tipping-off burners 50 and 51 are withdrawn to the outside of the outer periphery of the butting plate 36, and do not prevent the movement of the butting plate 36. After the seal welding of the bulb body 108 and the mount 101 is thus completed, the sealing burner 32 is turned off, and the bulb body 108 is exhausted through the exhaust tube 104 by the gas replacing apparatus (not shown). At this time, current flows from one of the conductive terminals 42 to the other conductive terminal 42 through one of the lead wires 106, the filament coil 105 and the other lead wire 106.

Heated by the filament coil 105, the electron emitting material attached to the coil 105 decomposes, thus liberating impurities. This phenomenon is called "flushing". The impurities thus liberated are discharged from the bulb 100. Thereafter, mercury and inert gas are introduced into the bulb body 108 through the exhaust tube 104 by the gas replacing apparatus (not shown).

Subsequently, the tipping-off burners 50 and 51 are ignited to cause gas flames to be injected from the flame nozzles 60, and are moved to their operating position where the gas flames can be injected into the flame inlet ports 46 and 47, thereby allowing the flame nozzles 60 of the burners 50 and 51 to adjoin and face the flame inlet ports 46 and 47, respectively. Then, the flame inlet ports 46 and 47 are filled with the gas flames injected from the flame nozzles 60, and part of the exhaust tube 104 facing the gas flames is heated and tipped-off. Thereafter, the tipping-off burners 50 and 51 are turned off and moved to their non-operating position, and then the fluorescent lamp 100 is removed from the manufacturing apparatus 10.

According to the manufacturing apparatus 10 thus constructed, the tipping-off burners 50 and 51 for tipping-off the exhaust tube 104 are located outside of the mount holder 18. Unlike the one used in the prior art apparatus, therefore, the tipping-off burners 50 and 51 never put restrictions on the inside diameter of the mount holder 18. As a result, if the outside diameter of the mount holder 18 is reduced in proportion to a reduction of the inside diameter of the butting plate 36, the inside diameter of the mount holder 18 can also be reduced correspondingly, and the wall of the mount holder 18 does not become extremely thin. Accordingly, the mechanical strength of the mount holder 18 can satisfactorily be secured, and the manufacturing apparatus 10 can be used without a hitch for manufacturing a fluorescent lamp with a reduced bulb diameter. Further, the tipping-off burners 50 and 51 need not be built in the mount holder 18, so that all these members may be simplified in construction, facilitating assembly and disassembly for maintenance, inspection, etc.

Since the tipping-off burners 50 and 51 are located outside of the mount holder 18, moreover, the gas flames injected from the burners 50 and 51 can easily be observed from the outside. Besides, the flame inlet ports 46 and 47 to receive the gas flames are relatively wide, so that the gas flames are stabilized to ensure more reliable fusion and sealing. In the present embodiment, the respective opening portions of the flame inlet ports 46 and 47 in the outer surface of the mount holder 18 are cut away, thus forming two parallel, rectangular surfaces 48 having a width substantially equal to the inside diameter of the flame inlet ports 46 and 47, so that the respective substantial lengths of the flame inlet ports 50 and 51 are shortened, allowing the respective flame nozzles 60 of the tipping-off burners 50 and 51 to be brought close enough to the exhaust tube 104. Thus, sufficient gas flames may be supplied to fuse and seal off the exhaust tube 104, and securer sealing off may be achieved.

Since the flame inlet ports 46 and 47 are off the lead wire insertion holes 24, moreover, the lead wires 106 will never be fired by the tipping-off burners 50 and 51, and will thus be protected from thermal deterioration such as oxidation.

In the above-mentioned embodiment, furthermore, the tipping-off burners are so constructed as to rock between the operating and non-operating positions. Alternatively, however, the tipping-off burners may be attached to the piston rod of a cylinder so as to be capable of straight movement, for example. The plane along which the tipping-off burners move is not limited to the plane at right angles to the central axis of the mount holder, and may be any other suitable plane which intersects the central axis of the mount holder at an angle.

The manufacturing apparatus of the present invention is not limited to the manufacture of fluorescent lamps, and may also be applied to any other bulbs provided with the mount of the above-mentioned construction, such as conventional incandescent lamps, etc.

What is claimed is:

1. In an apparatus for manufacturing bulbs each of which includes a bulb body having at least one opening edge defining an opening, and a mount contacted and sealed to the opening edge of the bulb body, the mount having a stem, an exhaust tube led out from the stem, a pair of lead wires led out from the stem, and a filament coil attached to the lead wires, comprising:

a mount holder for holding the mount, the mount holder having a pair of lead wire insertion holes through which the lead wires are passed severally, and an exhaust tube insertion hole through which the exhaust tube is passed;

a sealing burner arranged around the mount holder, and capable of fusing the contact portions of the periphery of said stem and the opening edge of the bulb body;

a butting plate arranged around the mount holder to be able to move along the axis of the mount holder toward the bulb, and capable of abutting on and pressing the fused contact portions of the stem and the bulb body; and a tipping-off means injecting flames toward a portion of the exhaust tube located inside the exhaust tube insertion hole to heat the portion, the improvement in which said mount holder includes at least one flame inlet port opening in the outer surface of the mount holder and communicating with the exhaust tube insertion hole, and said tipping-off means includes a tipping-off burner which is located outside of the mount holder and can move between a position where the tipping-off burner is closed enough to the mount holder to inject flames into the flame inlet port and a position where the tipping-off burner is kept away from the mount holder so as not a prevent the movement of the butting plate.

2. The apparatus according to claim 1, wherein said mount holder includes a cylindrical body with an outside diameter smaller than that of the bulb body, and the exhaust tube insertion hole is coaxial with the cylindrical body.

3. The apparatus according to claim 2, wherein said lead wire insertion holes are arranged parallel to the exhaust tube insertion hole and at an angular distance of 180° from each other along the circumferential direction of the mount holder.

4. The apparatus according to claim 3, wherein said mount holder includes two flame inlet ports each having a circular cross section.

5. The apparatus according to claim 4, wherein said flame inlet ports are arranged at right angles to the exhaust tube insertion hole, and at an angular distance of 180° from each other and at an angular distance of 90° from each the lead wire insertion hole along the circumferential direction of the mount holder and coaxialy with each other.

6. The apparatus according to claim 5, wherein each of said flame inlet ports has the same diameter greater than the diameter of the exhaust tube insertion hole.

7. The apparatus according to claim 6, wherein those portions of the outer surface of the mount holder in which said flame inlet ports open are cut away, thus forming two parallel, rectangular surfaces having a width substantially equal to the inside diameter of the flame inlet ports.

8. The apparatus according to claim 5, 6 or 7, which further comprises a base, a sealing head fixed on the base to support the mount holder, and an exhaust head disposed on the base so as to be movable along the axis of the mount holder.

9. The apparatus according to claim 8, wherein said tipping-off means includes two tipping-off burners which are mounted on the base.

10. The apparatus according to claim 9, wherein each said tipping-off burner includes a pair of brackets fixed on the base, a rocking link rockably supported by the brackets, and a burner body fixed to the rocking link and having a flame nozzle.

11. The apparatus according to claim 10, wherein the flame nozzle of each said tipping-off burner is located adjacent and opposite to its corresponding flame inlet port when the tipping-off burner is in the position where the tipping-off burner can inject flames into the flame inlet port, and the burner body and the rocking link are located off the movement path of the butting plate when the tipping-off burner is in the position where the tipping-off burner does not prevent the movement of the butting plate.

12. The apparatus according to claim 2, wherein said butting plate is in the form of an annulus with an inside diameter a little greater than the outside diameter of the mount holder, and capable of sliding along the outer peripheral surface of the mount holder.

13. The apparatus according to claim 2, which further comprises a base, a sealing head fixed on the base to support the mount holder, and an exhaust head disposed on the base so as to movable along the axis of the mount holder.

14. The apparatus according to claim 13, wherein said exhaust head includes a leading-in hole coaxial with the exhaust tube insertion hole, and a rubber clamp fitted in the leading-in hole and capable of airtightly chucking the extended end portion of the exhaust tube.

15. The apparatus according to claim 14, wherein said sealing burner is in the form of an annulus with an inside diameter greater than the outside diameter of the bulb body, coaxial with the mount holder, and fixed on the base.

* * * * *